US005714708A

United States Patent [19]

Shim et al.

[11] Patent Number: 5,714,708

[45] Date of Patent: Feb. 3, 1998

[54] MISSILE RESTRAINING APPARATUS

[75] Inventors: Woo-Jeon Shim; Il-Soo Kim; Kil-Ho Hong; Woo-Jin Lee, all of Daejon, Rep. of Korea

[73] Assignee: Agency For Defense Development, Daejon, Rep. of Korea

[21] Appl. No.: 720,024

[22] Filed: Sep. 27, 1996

[30] Foreign Application Priority Data

Sep. 29, 1995 [KR] Rep. of Korea ..... 32837/1995

[51] Int. Cl.[6] ..... F41F 3/00

[52] U.S. Cl. ..... 89/1.806; 89/1.8

[58] Field of Search ..... 89/1.806, 1.807, 89/1.8; 244/3.3, 110 R; 73/117.4

[56] References Cited

U.S. PATENT DOCUMENTS 3,296,929 1/1967 Jacobson ..... 89/1.806

4,304,170 12/1981 King ..... 89/1.807

4,550,640 11/1985 Harter ..... 89/1.806

5,056,407 10/1991 Mathey ..... 89/1.806

*Primary Examiner*—Michael J. Carone

*Assistant Examiner*—Theresa M. Wesson

*Attorney, Agent, or Firm*—David E. Lovejoy

[57] ABSTRACT

An improved missile restraining apparatus capable of effectively protecting a missile from an external impact and quickly releasing a missile restraining state when launching missile, which includes a pair of protrusions having a circular cross-section and formed in the rear portion of a missile, and a pair of brackets fixed to the inner surface of a launch tube and formed so that a pair of restraining grooves corresponding to said protrusions are formed in a predetermined direction, wherein one end of said restraining groove has a circular cross-section, and the other end thereof is shaped to have an elongating axis longer than the diameter of the protrusion in the radial direction and to have the same shorter axis as the restraining groove in the vertical direction.

3 Claims, 2 Drawing Sheets

MISSILE RESTRAINING APPARATUS

BACKGROUND OF THE INVENTION

1. Field of the Invention

The present invention relates to a missile restraining apparatus, and particularly to an improved missile restraining apparatus capable of effectively protecting a missile from an externally applied impact and quickly releasing a missile restraining state when launching a missile.

2. Description of the Conventional Art

Generally, a missile is inserted into a launch tube for preventing it from an external environment. Here, it is necessary to tightly and stably restrain the missile in the launch tube. In addition, when launching the missile, it is necessary to quickly release the restrained missile.

When restraining the missile, two missile protrusions formed in the rear portion of the missile are inserted into holes formed in brackets fixed to the inner surface of the launch tube.

However, in order to accurately insert the missile into the hole formed in the bracket, the hole of the launch-side bracket and the rear protrusion must be accurately matched and a high accuracy therebetween is necessary. In this regard, it is very difficult to do so.

Therefore, conventionally, the diameter of the hole of the bracket is larger than that of the protrusion of the missile, or a predetermined shaped fixing shim is inserted between the protrusion and the hole so as to prevent the missile from rolling therein.

However, in this case, it is very difficult to insert a predetermined shaped fixing shim therebetween. When the insertion is not accurately performed, there will be an interference between the missile protrusion and the launch tube, so that a force is applied to the rear portion of the missile, and the launch tube may be deformed.

Meanwhile, U.S. LTV company disclosed a similar apparatus which was adopted to a land-to-air missile.

This apparatus is directed to providing screws for restraining a missile restraining shim to the rear protrusion of the missile and to inserting a shim between the restraining member and the launch tube for controlling the thickness thereof, and to restraining the restraining member to the launch tube using bolts.

However, since this apparatus is directed to inserting the shim between the restraining member and the launch tube, the shim insertion operation is very difficult to do. In addition, it is impossible to quickly release the restrained missile.

SUMMARY OF THE INVENTION

Accordingly, it is an object of the present invention to provide a missile restraining apparatus, which overcomes the problems encountered in a conventional missile restraining apparatus.

It is another object of the present invention to provide an improved missile restraining apparatus capable of effectively protecting a missile from an external impact and quickly releasing a missile restraining state when launching missile.

To achieve the above objects, there is provided a missile restraining apparatus, which includes a pair of protrusions having a circular cross-section and formed in the rear portion of a missile, and a pair of brackets fixed to the inner surface of a launch tube and formed so that a pair of restraining grooves corresponding to said protrusions are formed in a predetermined direction, wherein one end of said restraining groove has a circular cross-section, and the other end thereof is shaped to have an elongating axis longer than the diameter of the protrusion in the radial direction and to have the same shorter axis as the restraining groove in the vertical direction.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
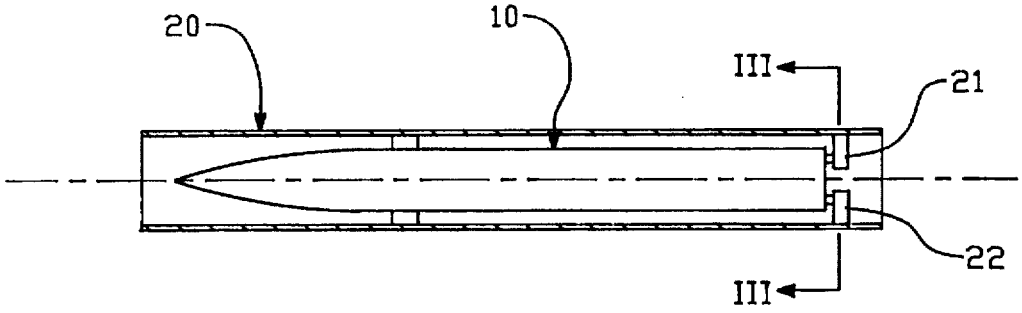
FIG. 1 is a cross-sectional view showing a missile restraining apparatus according to the present invention.

FIG. 1 is a cross-sectional view illustrating a missile restraining apparatus according to the present invention.

In the drawings, reference numeral 10 denotes a missile, and 20 denotes a launch tube.

Figure 2:
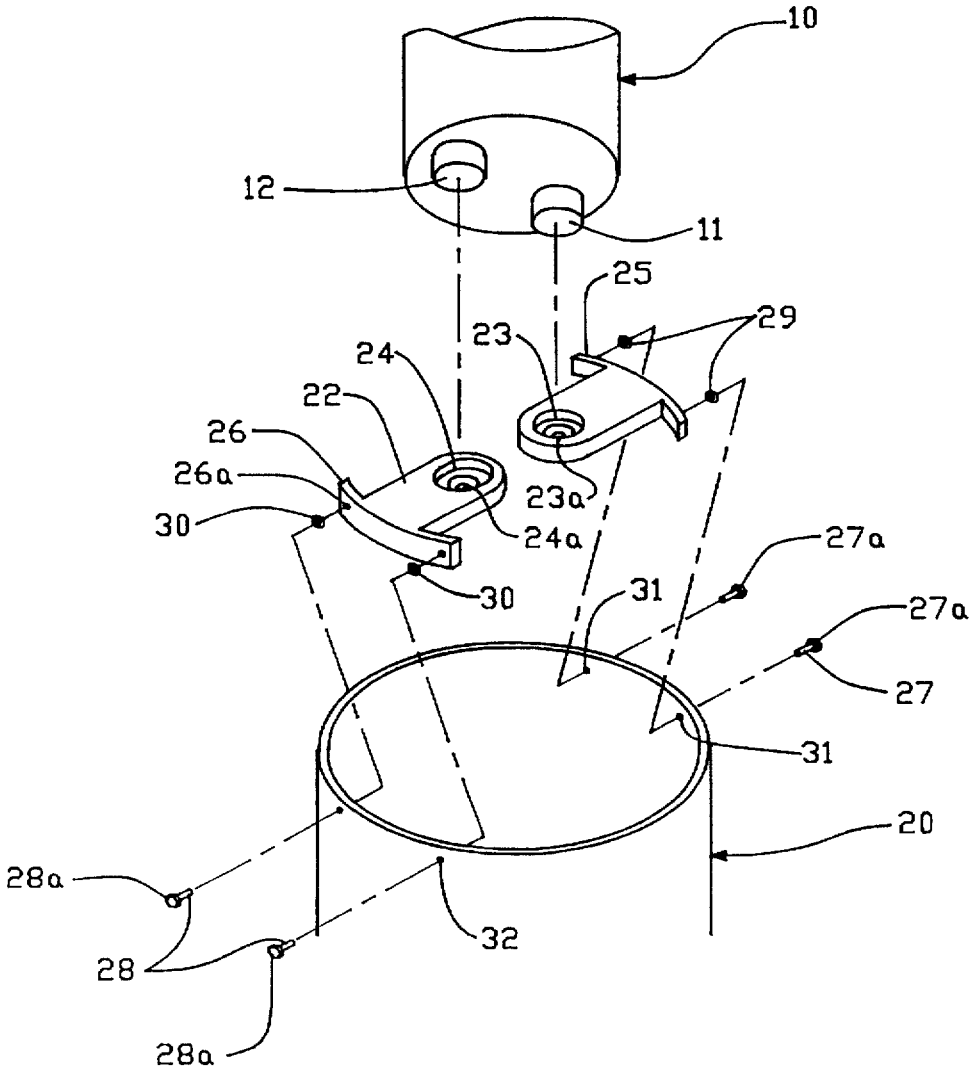
FIG. 2 is an exploded view of a missile restraining apparatus according to the present invention.

In addition, FIG. 2 illustrates an exploded missile restraining apparatus according to the present invention. As shown therein, there are provided first and second protrusions 11 and 12 formed at the rear portion of a missile 10, and a pair of brackets 21 and 22 having first and second restraining grooves 23 and 24 which are formed toward the head portion of the missile and fixed to the inner surface of a launch tube 20.

The cross-sections of the first and second protrusions 11 and 12 are circular. In addition, a first restraining groove 23 is also circular. The second restraining groove 24 is elongated and longer than the diameter of the first restraining groove 23 radially formed from the launch tube 20, and is elongated and has a shorter length which is the same as the diameter of the first restraining groove 23.

Holes **23*a* and 24*a* passing through the brackets 21 and 22 are formed in the central portion of the first and second restraining grooves 23 and 24**.

Fixing sections 25 and 26 each having curved section formed in the inner surface of the launch tube 20 are formed in the outer end portions of the brackets 21 and 22, and brackets 21 and 22 are fixed to the launch tube 20 by engaging the fixing screws 27 and 28 passing through the screw through holes 31 and 32 of the launch tube 20 to the screw holes **25*a* and 26*a* formed within the fixing sections 25 and 26 of the brackets 21 and 22**.

When assembling the missile restraining apparatus of the present invention and the launch tube, the missile 10 is inserted into the launch tube 20. The first protrusion 11 is inserted into the first restraining groove 23 of the second bracket 21. The second protrusion 12 is inserted into the second restraining groove 24 of the second bracket 22.

At this time, the first restraining groove is circular, and the second restraining groove is elliptical, and the first protrusion 11 and the first restraining groove 23 are circular, so that a predetermined force applied in the direction of the gravity effectively restrains the missile with respect to the missile from any directions which is vertical with respect to the direction of the gravity.

Meanwhile, the first protrusion 11 and the first restraining groove 23 act for the same function with respect to the direction of the gravity of the second protrusion 12 and the second restraining groove 24, and with respect to a predetermined direction vertical to the direction of the gravity, the missile is movable in the elongating direction of the second restraining groove 24, so that it is possible to prevent the missile from rolling about the first protrusion 11 and the first restraining groove 23.

As a result, with respect to an applying force of the restraining groove which does not effectively restrain the missile by the second protrusion 12 and the second restraining groove 24, it is possible to compensate the force by a combination between the first protrusion 11 and the first restraining groove 23.

In addition, since the second protrusion 12 and the restraining groove are movable in the elongating direction thereof, it is possible to easily assembly the missile and the launch tube because it is possible to control them by varying the force therebetween. After the missile and the launch tube are assembled, there is not any interference between the second protrusion 12 and the bracket 22, so that the deformation of the launch tube 20 is effectively prevented.

In addition, since it is unnecessary to do a shim work, the assembling operation is made easier.

Figure 3A:
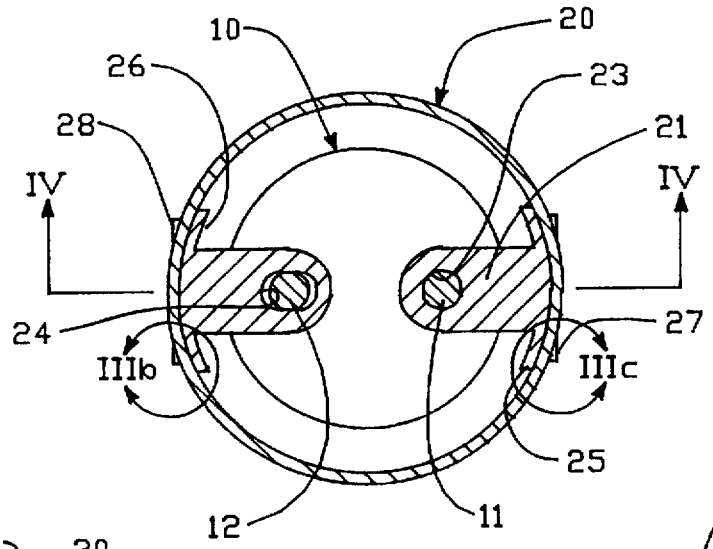
FIG. 3 is an enlarged cross-sectional view taken along line III—III of FIG. 1 according to the present invention.
Figure 3B:
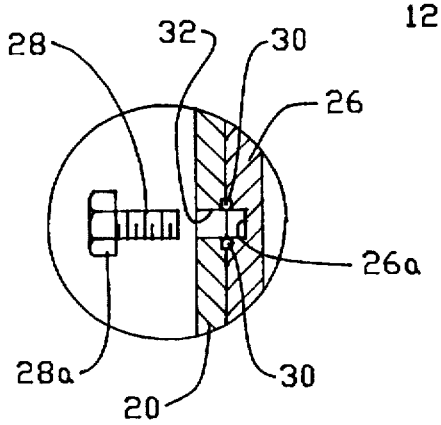
Figure 3C:
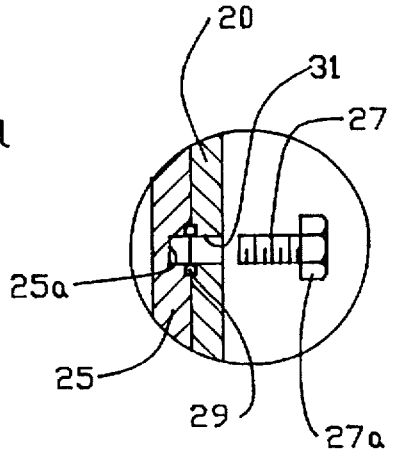
Figure 4:
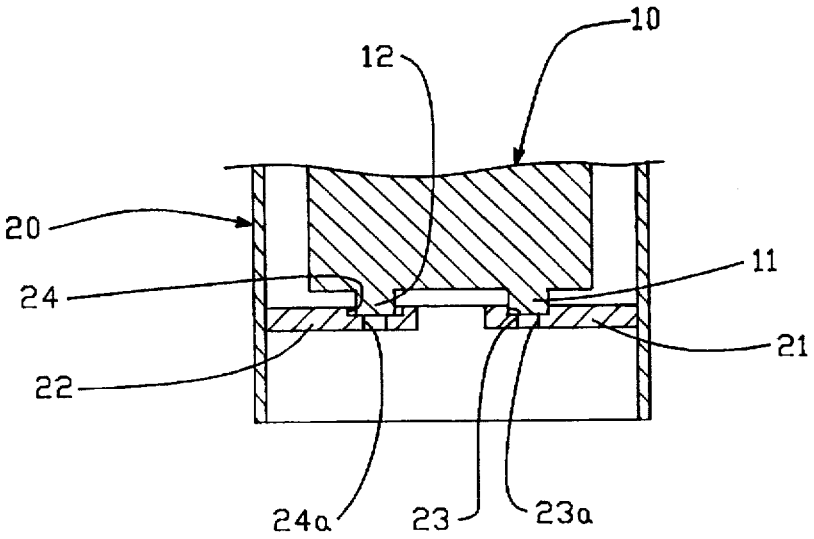
FIG. 4 is an enlarged cross-sectional view taken along line IV—IV according to the present invention.

FIG. 3 is an enlarged cross-sectional view taken along line III—III of FIG. 1 according to the present invention, and FIG. 4 is an enlarged cross-sectional view taken along line IV—IV according to the present invention.

Moreover, there are provided the screw through holes 31 and 32 passing through the fixing screws 27 and 28 in the launch tube 20, and the fixing screw 27 and 28 are inserted thereinto through the wall of the launch tube 20 so as to fix the brackets 21 and 22. In addition, it is selectively possible to insert the circular rings 29 and 30 between the head sections **27*a* and 28*a* of the fixing screws 27 and 28 and the outer circumferential surface of the launch tube 20** for the same purpose of the present invention.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A missile restraining apparatus, comprising:

a pair of protrusions having a circular cross-section and formed in the rear portion of a missile; and a pair of brackets fixed to the inner surface of a launch tube and formed so that a pair of restraining grooves corresponding to said protrusions are formed in a predetermined direction, wherein one end of said restraining groove has a circular cross-section, and the other end thereof is shaped to have an elongating axis longer than the diameter of the protrusion in the radial direction and to have the same shorter axis as the restraining groove in the vertical direction.

2. The apparatus of claim 1, wherein said bracket is fixed to the launch tube so that a curved fixing section contacting with the inner curved surface of the launch tube is radially extended in the direction of the launch tube so as to fix fixing screws to the fixing section.

3. The apparatus of claim 2, wherein a head section of said fixing screw and an outer circumferential surface of said launching tube are inserted by a plurality of rings so that the launch tube is tightly engaged.

* * * * *